United States Patent [19]

Morin

[11] 4,287,615

[45] Sep. 8, 1981

[54] HELMET HAVING A WITHDRAWABLE SHIELD

[76] Inventor: Claude P. Morin, 16 bis Rue A. PRO, 77 Vaux Le Penil, France

[21] Appl. No.: 126,755

[22] Filed: Mar. 3, 1980

[30] Foreign Application Priority Data

Mar. 2, 1979 [FR] France ..... 79 05445

[51] Int. Cl.[3] ..... A42B 3/02; A61F 9/04

[52] U.S. Cl. ..... 2/424; 2/10; 2/425

[58] Field of Search ..... 2/424, 10, 6, 8, 9, 2/453, 425

[56] References Cited

U.S. PATENT DOCUMENTS 3,601,814 8/1971 Manz ..... 2/8
3,636,565 1/1972 Luisada et al. ..... 2/6

FOREIGN PATENT DOCUMENTS 471197 10/1974 Australia ..... 2/10
57205 1/1940 Denmark ..... 2/10
2402455 4/1979 France ..... 2/424

*Primary Examiner*—Peter P. Nerbun
*Attorney, Agent, or Firm*—Sughrue, Mion, Zinn, Macpeak and Seas

[57] ABSTRACT

In this helmet, the shield has a lower notch adapted to rest on the nose of the user and is connected by an elastically yieldable connection to a support which is pivotally mounted on the outer shell of the helmet. This connection biases the shield inwardly of the helmet. The shield in this way adapts itself to the morphology of the user.

Application in ski crash-helmets.

7 Claims, 4 Drawing Figures

HELMET HAVING A WITHDRAWABLE SHIELD

DESCRIPTION

BACKGROUND OF THE INVENTION

The present invention relates to a helmet having a withdrawable shield of the type in which the shield has a lower notch adapted to rest on the nose of the user and is connected to a support which is pivoted to the outer shell of the helmet.

In known helmets of this type (see for example French Pat. No. 1446416) the shield is rigidly fixed to its pivotal support. This shield consequently cannot be in any way adjusted in the direction from the front to the rear in the lowered position, which constitutes a serious drawback.

An object of the invention is to provide a helmet of the same type in which the shield may indeed rest on the nose of the user in the manner of a pair of goggles or spectacles irrespective of the dimension of the head of the user.

SUMMARY OF THE INVENTION

According to the invention, there is provided a helmet having a withdrawable shield of the aforementioned type, wherein the shield is connected to the support by an elastically yieldable connection which biases it inwardly of the helmet.

Preferably, and in particular for a ski crash helmet, the support is located within the outer shell of the helmet and is provided with actuating means which are accessible from outside the shell, a space for housing the shield in the withdrawn position thereof being provided in the front part of the shell.

Further features and advantages of the invention will be apparent from the ensuing description which is given merely by way of example with reference to the accompanying drawings in which:

DETAILED DESCRIPTION OF THE INVENTION

Figure 1:
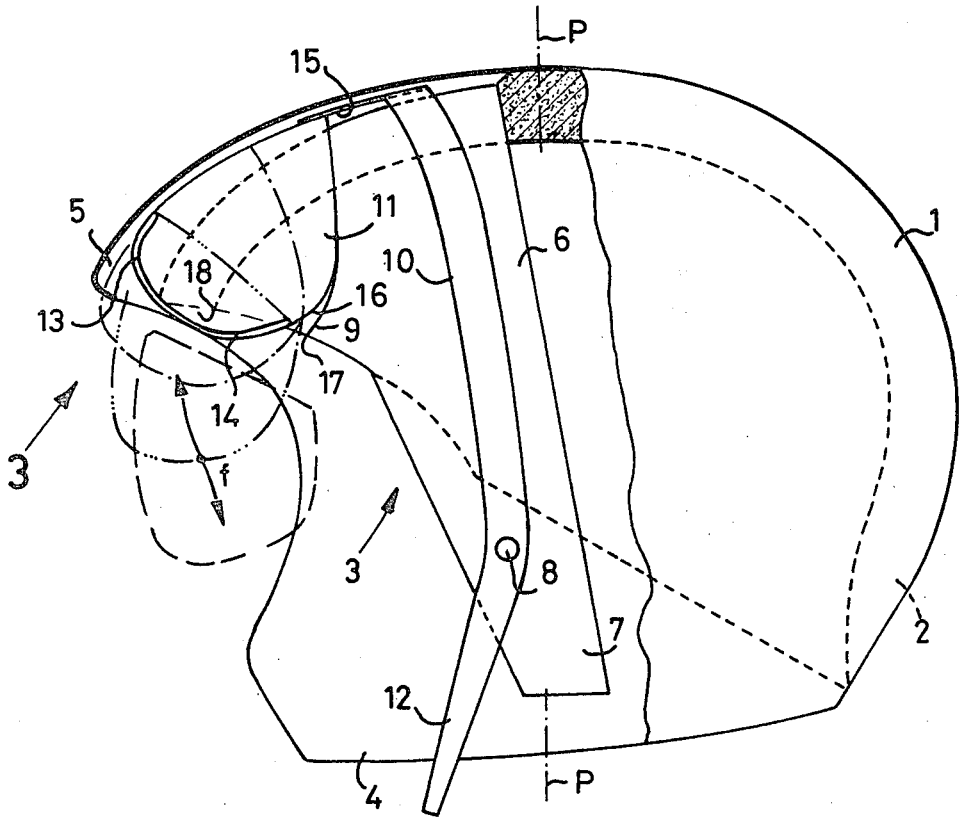
FIG. 1 is a side elevational view, with a part cut away, of a helmet according to the invention.

The helmet for a skier shown in FIG. 1 is symmetrical relative to a vertical median plane which is the plane of this Figure. It comprises a rigid outer shell 1, for example of moulded plastics material, a shock absorbing lining or soft skull-cap 2 which is for example of expanded plastics material, and a withdrawable shield device 3.

The shell 1 has a conventional shape which is roughly ¾ of a sphere extended forwardly and downwardly by two lateral roughly planar cheek portions 4. These two cheek portions may, in a modification, extend forwardly and be interconnected by a transverse strip (not shown) so as to give a so-called "integral" shape to the helmet.

The cap 2 exactly fits the inside shape of the shell 1 in the rear half of the latter to which it adheres. Beyond the transverse diametral plane P, it is extended forwardly at substantially the same radius of curvature while it progressively moves away from the shell as the base of the cap is reached. An outwardly widening space 5 is thus defined in the front upper part of the helmet between the shell 1 and the cap 2.

An element 6 of the shield device 3 externally lines this front part of the cap 2 and consequently defines the lower limit of the space 5. This element 6 is formed by a relatively rigid thin quarter of a sphere which is downwardly extended on each side by a side portion 7 which extends beyond the cap 2 and terminates a little short of the lower edge of the shell 1, in the vicinity of the plane P. Each side portion 7 has extending therethrough a rivet 8 which connects it to the shell 1. A downward or shoulder step 9 is provided on each side in the front upper part of the element 6. This step has, in side view (FIG. 1), the shape of a ramp which is first at roughly 45° and then curves upwardly.

In addition to the element 6, the device 3 comprises a bow member 10 and a shield or goggles 11. The bow member 10 forms a half circle whose radius is slightly less than that of the shell 1. At each end, it is pivotally mounted on the rivet 8 and is extended downwardly by a rectilinear lever 12 adjacent to the corresponding cheek portion 4. This lever 12 extends beyond the lower edge of the shell 1.

Figure 3:
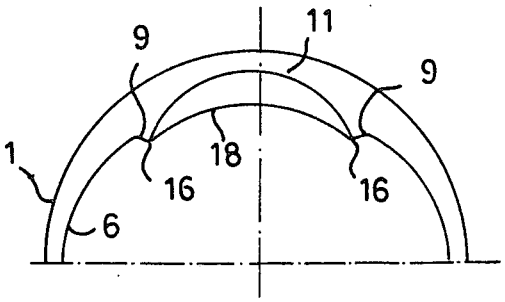
FIG. 3 is a partial view in the direction of arrow 3 of FIG. 1.

The shield 11 is made from transparent plastics material which may be smoked or tinted. It has the conventional shape of a single-piece enveloping pair of goggles with a lower notch 13 adapted to rest on the nose of the user. Its periphery is continuous and devoid of corners and it is bordered in its lower part by a sealing element 14 of foam material. The maximum width of the shield 11 is equal to the distance between the start of the two ramps 9. As shown in the underside view of FIG. 3, the transverse curvature of this shield exceeds that of the part of the element 6 which is located between the ramps 9.

An elastically yieldable strip or tab 15 having a substantially rectangular narrow shape, is fixed at one end to the top of the shield 11 and at the other end to the top of the bow member 10. It is possible to envisage the construction of the shield, the bow member and this tab 15 in one piece of a suitable plastics material.

The device 3 operates in the following manner:

In the completely withdrawn position shown in FIG. 1, the bow member is located at the inner end of the space 5, in the vicinity of the plane P. The shield 11 is completely, or practically completely, housed within the front part of this space 5. It bears, solely by its lateral edges, on the ramps 9. More precisely, the points 16 of this shield the most remote from each other, located above the ends of the sealing element 14, bear against the junction between the roughly rectilinear part and the curved part of the ramps 9, whereas the upper edge of the shield abuts the element 6 in the vicinity of the inner end of these ramps. In this position, the tab 15 is stressed and urges the shield 11 against the element 6.

When the user of the helmet wishes to protect his eyes, he urges the ends of the levers 12 simultaneously rearwardly. The bow member 10 swings forwardly and urges the shield 11 forwardly through the tab 15. FIG. 1 shows several positions of the shield in order to illustrate the complex movements described by the latter. The points 16 slide along the ramps 9 until they reach the outer ends 17 of the latter. Then the shield 11 pivots roughly by these points 16 about the ends 17, after which points of the upper edge of the shield progressively nearer to the top thereof slide on the front edge 18 of the element 6 located between the two points 17. Thereafter, the shield 11 which is fully disengaged from the element 6 is urged elastically inwardly of the helmet by the release of the tab 15.

Figure 2:
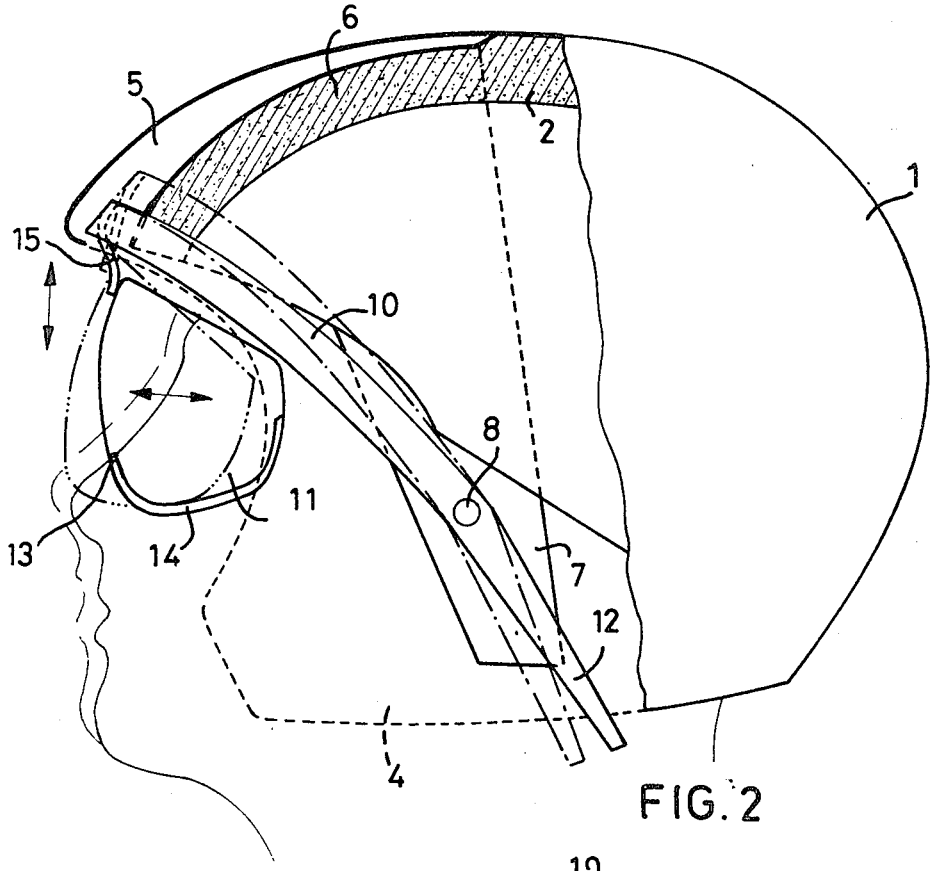
FIG. 2 is a similar view, partly in section, illustrating the adaptability of the shield.

As shown by the two arrows in FIG. 2, this shield thus has a double possibility of adaptation to the morphology of the user: on one hand, in height, according to the more or less advanced position of the bow member 10, and, on the other hand, horizontally, owing to the elastic thrust, in the direction inwardly of the helmet, exerted by the tab 15. The length of the tab is so calculated that the shield is capable of being applied on the smallest head on which the helmet is intended to be used. FIG. 2 shows in full lines the positions of the shield 11 and the bow member 10 in respect of a small head and in dot-dash lines the corresponding positions in respect of a larger head, in which the shield is urged forwardly and upwardly by the nose and causes the bow member 10 to be moved slightly rearwardly and upwardly.

It will be understood that the breathing is effected outside the vision area, so that no vapour is deposited on the shield.

In order to raise or withdraw the shield 11, the user pulls the ends of the levers 12 forwardly. Two points of the upper edge of the shield in the vicinity of the top thereof engage the edge 18 of the element 6, and then the shield undergoes a complex movement which is the reverse of that described hereinbefore until it is completely housed within the space 5. Arrow f of FIG. 1 shows the path followed by a point of the shield in the course of this movement. The shape of the ramps 9 is so chosen that the shield finally takes up a position very close to the shell 1 without touching it so as to occupy a minimum of space with no danger of the shield being scratched.

It will be observed that, in the course of the movements for moving the shield out of or into the helmet, only a rigid edge of the shield participates in the guiding thereof with no intervention on the part of the vision surface of the shield, so that there is no risk of scratching, and no intervention of the sealing element 14 so that there is no risk of its becoming removed or damaged.

By way of a modification, the levers 12 may be replaced by any other actuating means accessible from the exterior, for example knobs, tabs or other means.

Figure 4:
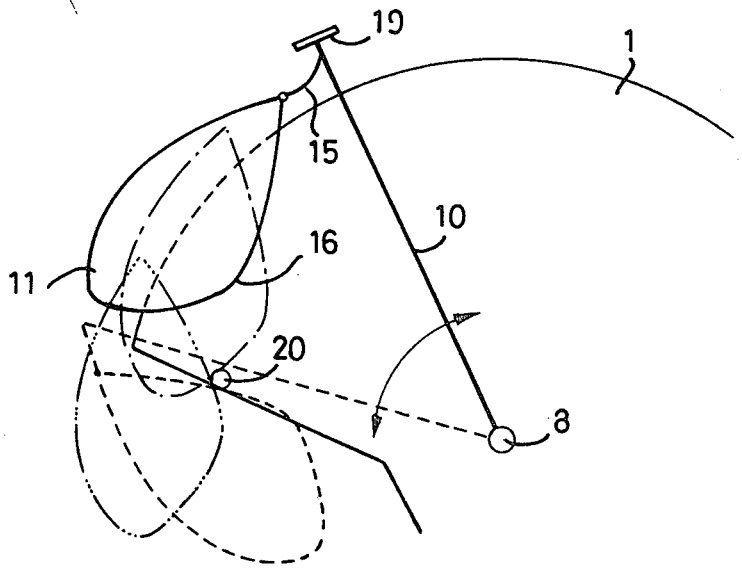
FIG. 4 is a diagrammatic view of a modification of the helmet according to the invention.

Also by way of a modification, the ramps 9 may be replaced by other guiding means which are judiciously located, such as studs. This is illustrated in FIG. 4 which shows the application of the invention to a simpler helmet, for example a helmet of a welder in which no aerodynamic effect is required. In such a helmet, the shield may be withdrawn outside the shell 1 with no inconvenience. The bow member 10 thus follows the outer surface of this shell and the levers 12 may be replaced by a simpler actuating means, such as a knob 19 located at the top thereof. Moreover, as the shield has no need to occupy a minimum space in the withdrawn position, it is guided simply by two outer studs 20 fixed to the shell 1. The movement for withdrawing the shield starts in the same way as before, the studs 20 performing the function of the points 17 shown in FIGS. 1 and 3. Thereafter, the points 16 of the shield slide directly on the outer surface of the shell 1. FIG. 4 shows in dot-dash lines several positions of the shield. It will be understood that an abutment (not shown) may be employed for limiting the upward movement of the bow member 10.

Having now described my invention what I claim as new and desire to secure by Letters Patent is:

1. A helmet structure comprising an outer shell, a shield which is movable between a position of use in front of the eyes of the wearer of the helmet and a withdrawn position and has a lower notch adapted to rest on the nose of the wearer, a support for the shield and comprising a bow member which is mounted in two diametrically opposed lateral portions of the bow member on the outer shell to pivot relative to the shell substantially forwardly and downwardly to bring the shield to said position of use and substantially rearwardly and upwardly to bring the shield to said withdrawn position, and which has an intermediate portion intermediate said lateral portions, and elastically yieldable connecting means connecting the shield to said intermediate portion of the bow member and being operative to bias the shield relative to the bow member inwardly of the shell in said position of use of the shield, in which position of use the shield is free to be moved by the biasing action of the elastically yieldable means.

2. A helmet structure as claimed in claim 1, wherein the bow member is located inside the outer shell of the helmet and bow member shifting means which are accessible from outside the shell are combined with the bow member, means defining a space for housing the shield in the withdrawn position thereof being provided in a front part of the shell.

3. A helmet structure as claimed in claim 2, wherein the shifting means comprise levers which extend the bow member on both sides of the shell and extend beyond a lower edge of the outer shell.

4. A helmet structure as claimed in claim 3, wherein the elastically yieldable connecting means comprise an elastically yieldable strip which connects the intermediate portion of the bow member to a portion of the shield which is intermediate lateral portions of the shield adjacent the top of the shield.

5. A helmet structure as claimed in claim 4, wherein the shield, the bow member and the strip are made in one piece.

6. A helmet structure as claimed in claim 1 or 2 comprising means for guiding the shield in the course of the movement thereof to said withdrawn position.

7. A helmet structure comprising an outer shell, a shield which is movable between a portion of use in front of the eyes of the wearer of the helmet and a withdrawn position and has a lower notch adapted to rest on the nose of the wearer, a support for the shield and comprising a bow member which is mounted in two diametrically opposed lateral portions of the bow member on the outer shell to pivot relative to the shell substantially forwardly and downwardly to bring the shield to said position of use and substantially rearwardly and upwardly to bring the shield to said withdrawn position, and which has an intermediate portion intermediate said lateral portions, elastically yieldable connecting means connecting the shield to said intermediate portion of the bow member and being operative to bias the shield relative to the bow member toward a center region of the inside of the shell throughout the movement of the shield between said withdrawn position and said position of use, the shield being free to be moved by the biasing action of the elastically yieldable connecting means in said position of use, and guide means carried by the shell in positions for engaging and guiding the shield in laterally outer regions of the shield and for displacing the shield relative to the bow member and deforming the yieldable connecting means in a direction opposed to the biasing action thereof when the shield has been shifted substantially away from said position of use in front of the eyes of the wearer of the helmet structure and moves toward said withdrawn position.

* * * * *